US005488344A

United States Patent [19]

Bisbee et al.

[11] Patent Number: 5,488,344

[45] Date of Patent: Jan. 30, 1996

[54] TOROIDAL TRANSFORMER INSULATION PREFORMS

[76] Inventors: Philip I. Bisbee, 527 Meadow La., Versailles, Ky. 40383; James D. Richerson, 534 Sheffield Dr., Versailles, Ky. 40383; Stephen D. Smith, 107 Shady La., Lawrenceburg, Ky. 40342; Eric S. Richardson, 300 Scotts Ferry Rd. East, Versailles, Ky. 40383

[21] Appl. No.: 971,000

[22] Filed: Nov. 3, 1992

[51] Int. Cl.[6] ..... H01F 27/32

[52] U.S. Cl. ..... 336/206; 336/208; 336/229

[58] Field of Search ..... 336/206 O, 207, 336/208, 199, 229

[56] References Cited

U.S. PATENT DOCUMENTS

| | | | |
|---|---|---|---|
| 1,213,929 | 1/1917 | Merriman . | |
| 2,723,933 | 11/1955 | Isenberg . | |
| 2,826,524 | 3/1958 | Molloy . | |
| 2,865,086 | 12/1958 | Whipple . | |
| 3,301,727 | 1/1967 | Verrell et al. . | |
| 3,871,934 | 3/1975 | Marin . | |
| 4,187,932 | 2/1980 | Zarembka . | |
| 4,373,680 | 2/1983 | Polge . | |
| 4,665,952 | 5/1987 | Macemon et al. . | |
| 4,733,213 | 3/1988 | Graul | 336/206 |
| 4,771,957 | 9/1988 | Schlake et al. . | |
| 4,877,567 | 10/1989 | Yoshizumi et al. | 264/153 |
| 4,912,446 | 3/1990 | Singh et al. | 336/62 |
| 5,028,905 | 6/1991 | Loshimo | 336/205 |

FOREIGN PATENT DOCUMENTS

| | | |
|---|---|---|
| 876475 | 10/1979 | U.S.S.R. . |
| 1123976 | 11/1984 | U.S.S.R. . |
| 567030 | 1/1945 | United Kingdom . |

*Primary Examiner*—Laura Thomas

*Attorney, Agent, or Firm*—Townsend and Townsend and Crew

[57] ABSTRACT

Insulation tubing (66) having adjustable dimensions is disclosed. The insulation tubing has an outer tubular wall that defines a central opening for receiving the core (4) and windings (8) of a partially assembled toroidal transformer. The wall is formed by preformed sections (44, 62) of electrical insulating material (10–20). The preformed sections have overlapping surfaces that are slidably positioned relative to one another. In this way, the extent of the surfaces that overlap can be changed to alter the size of the opening such that conductive windings (8) of various sizes and configurations can be accommodated.

25 Claims, 6 Drawing Sheets

TOROIDAL TRANSFORMER INSULATION PREFORMS

BACKGROUND OF THE INVENTION

The present invention relates to insulation construction generally, and more particularly to electrical insulation that are suitable for use in conjunction with toroidal transformers.

Toroidal transformers have included insulation in the form of arcuate (semi-toroidal) tubes which surround a portion of the core (and bobbin if used) of the transformer. U.S. Pat. No. 4,665,952 to Macemon, et al. (the disclosure of which is hereby incorporated herein) describes a toroidal transformer having two such tubes. Together the tubes form approximately 330° of a toroid and serve to insulate the low voltage windings that surround the insulation tube from the core.

Each insulating tube described in U.S. Pat. No. 4,665,952 is formed from electrical kraft insulating paper that is wet molded into the form of the tube. As is well known in the art, electrical kraft paper performs an insulating function by virtue of oil-impregnation. Because of the excellent insulation properties of oil-impregnated electrical kraft paper, electrical kraft paper is widely used in transformer construction. To ensure proper oil-impregnation of the kraft paper, and thereby ensure that the insulation will have the appropriate dielectric strength, transformers are typically heated and evacuated after assembly to remove the moisture and air from the kraft paper. Oil is introduced into the evacuated transformer filling the microscopic spaces in the electrical kraft paper that were occupied by air before the evacuation.

Even though electrical kraft paper can be successfully molded by wetting the paper, the process is expensive. The wet molding method, as is well known, requires a time-consuming drying step before the molded paper insulation can be used. Efforts to speed up the drying process by applying heat have been only partially successful, since very high temperatures, which would cause the water to vaporize into steam, would damage the paper. Accordingly, only relatively low temperatures can be used resulting in long drying times.

In addition to the cost disadvantage of the molded paper insulation, the insulation kraft paper tube has strength limitations relative to the heavy forces imposed upon the tube when heavy-gauge conductors are wound upon the tube. This required the use of a relatively close-fitting arbor placed internally in the tube to support the walls during winding as disclosed in U.S. Pat. No. 4,771,957 to Schlake, et al. To prevent the walls from collapsing during winding of the relatively heavy gauge conductor, it was necessary to have close dimensional correspondence between the electrical kraft paper tube and the internally positioned arbor. That dimensional requirement complicated manufacture of the electrical kraft paper tube since it added a manufacturing tolerance that was not easily met in a wet-molded paper product.

Electrical kraft paper tubes have also been made by forming a long strip of paper in a spiral with the edges of the paper being overlapped to form a continuous piece of insulation. The overlapped sections created raised portions on the surface of the tube which often resulted in cross-overs in the windings wrapped therearound. This reduced the transformer's efficiency.

Efforts to resolve some of the aforementioned problems have included substituting plastic materials for the oil-impregnated electrical kraft paper. However, the fixed dimensions of the relatively inelastic plastic tubes have been found deficient in that they generally are not capable of closely conforming to the actual configuration of the core. Accordingly various tubes of different dimensions must be inventoried to accommodate cores of different sizes.

Therefore, there is a need to provide insulation tubing that can withstand the electrical and mechanical stresses between the core and outer windings, while being capable of closely conforming to the configuration of the core.

SUMMARY OF THE INVENTION

The present invention is directed to an insulation system that avoids the problems and disadvantages of the prior art. The invention accomplishes this goal by providing a tubular insulation layer surrounding and conforming to the electrical windings used in constructing a toroidal transformer. The insulation layer is formed using preformed sections of electrical insulating material. The preformed sections have overlapping surfaces that are slidably positioned relative to one another during assembly. In this way, the extent of the surfaces that overlap can be changed to alter the size of the opening such that conductive windings of various sizes and configurations can be accommodated.

The corners of the preformed sections are substantially thicker than their walls. This construction provides the tubular member with the requisite strength to withstand the mechanical and electrical stresses between the windings in the corner regions.

Another aspect of the invention is that the sections can be formed using sheets of material. The sheets can be arranged to provide the desired configuration of the preformed section. First, the sheets are layered such that each sheet of a respective section forms a portion of the corner wall of that section. In this way, the sheet construction provides a versatile and simple way in which to construct the insulation layer with thickened corner walls. Second, the individual sheets are preferably stretchable, such as is achieved with crepe kraft paper. The crepe allows the kraft paper to change size, that is to stretch, in the direction of the crepe to accommodate changes in mechanical dimensions. The sheets are layered such that the orientation of the stretch direction or the crepe grain of each layer are transverse to adjacent layers to allow elastic deformation of the compound preformed section. For example, if a particular core assembly is slightly smaller in diameter than the average, then the preform, especially along its inner circumference, will conform to the core surface without buckling, due to the accordion-like movement of the crepe paper, when the wire is wound on top of it. That is, the crepe takes up changes in dimensions without buckling and folding, which can cause improper wire lays during the subsequent winding operations.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENT

Figure 1:
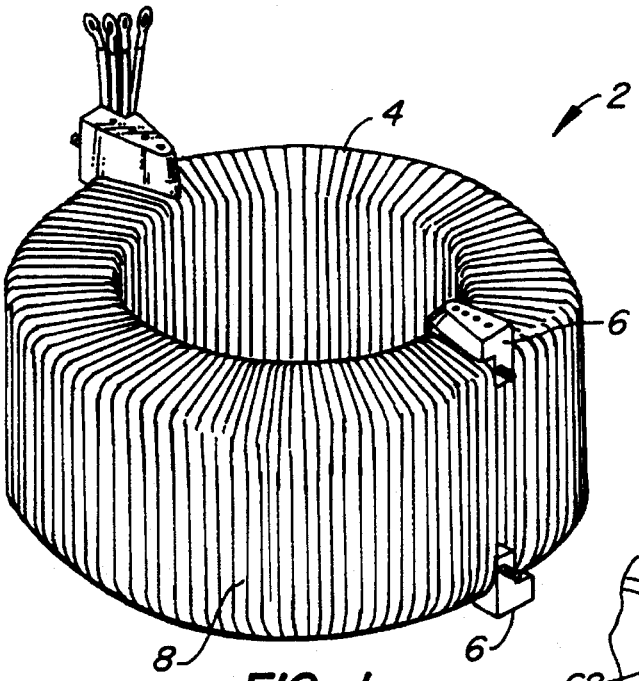
FIG. 1 is an overall view of a partially assembled toroidal transformer with a core, support blocks mounted to the core and a winding around about the core.

FIG. 1 illustrates a partially assembled toroidal transformer 2 including a core 4 to which core support blocks 6 are secured. See U.S. patent application Ser. No. 07/820,708 filed Jan. 14, 1992 and now U.S. Pat. No. 5,248,952, for Transformer Core and Method for Finishing, by Bisbee (the disclosure of which is incorporated by reference), for a discussion of the assembly of core 4. Windings 8 are wound in two segments between each set of core support blocks 6. See U.S. patent application Ser. No 07/970,713 filed on the same day as this application for Core Support Blocking for Toroidal Transformers, by Bisbee, Smith and Richardson (the disclosure of which is incorporated by reference), now U.S. Pat. No. 5,319,341 for a description of core support blocks 6. In the manufacture of transformer 2, windings 8 are made from electrical conductors having a very thin layer of insulation applied to the conductors. Therefore extra insulation is preferably added between each layer of windings. It has been found that a single layer of kraft paper is sufficient insulation between layers of low voltage windings. However, the present invention has been developed to accommodate the physical and electrical forces created between layers of high voltage windings and between low and high voltage windings.

Figure 2:
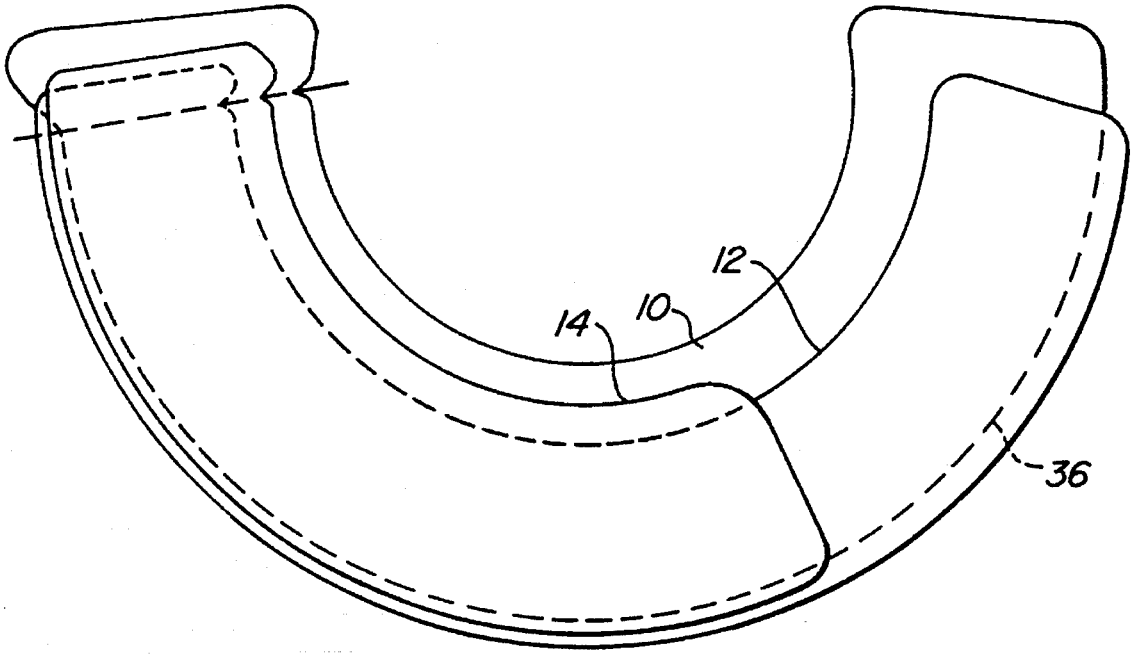
FIG. 2 is a plan view of three arcuate outer edge end surface barrier layers laid one on top of the other as they are arranged in creating an outer preformed insulation section.
Figure 3:
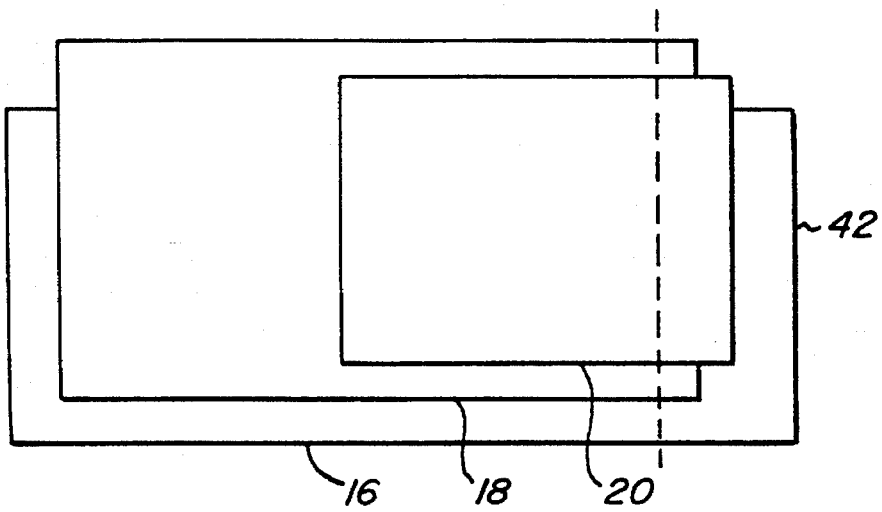
FIG. 3 is a plan view of rectangular outer circumferential surface barrier layers as they relate to one another when forming an outer preformed insulation section.
Figure 4:
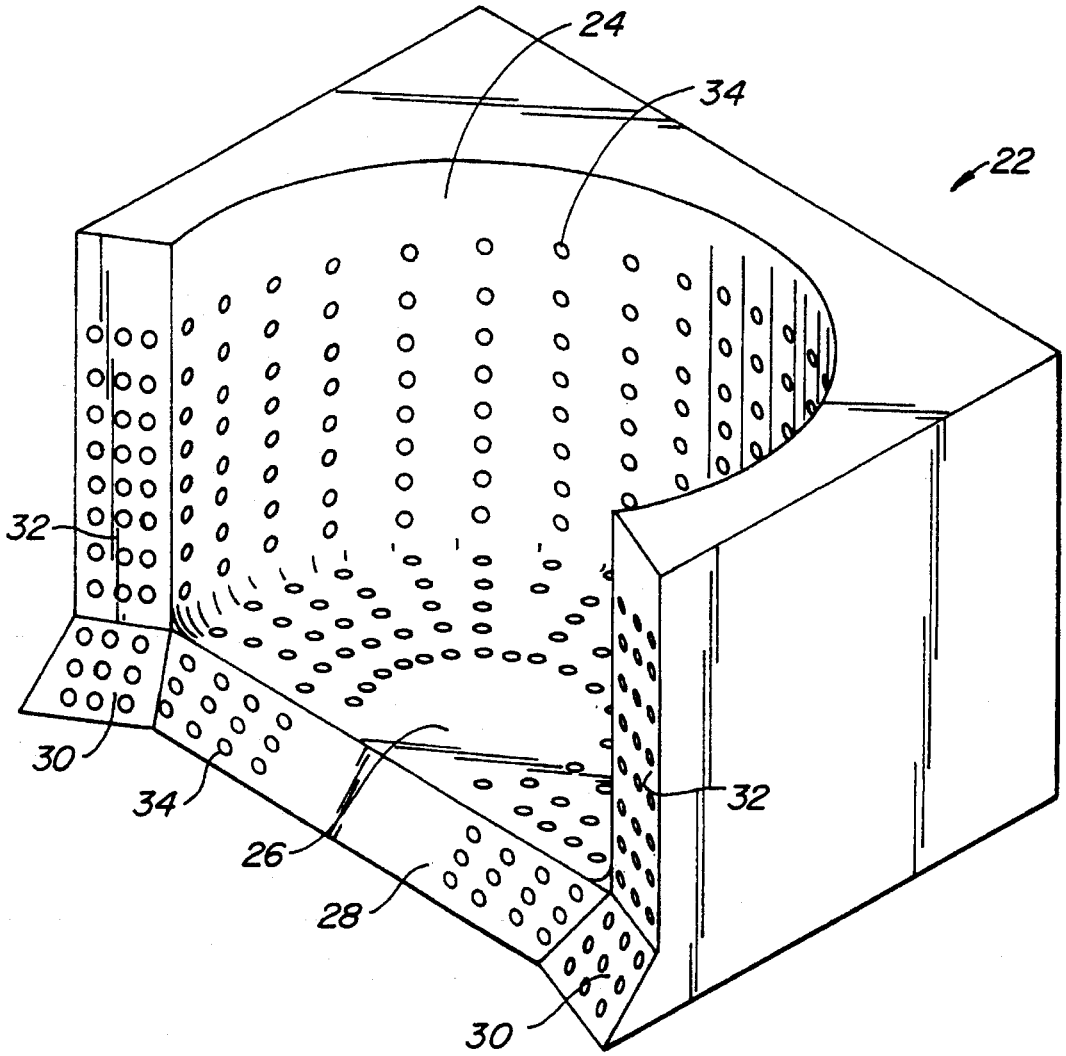
FIG. 4 is a perspective view of a vacuum forming box used to form outer preformed insulation sections.

FIGS. 2 and 3 illustrate the shapes of flat sheets of creped kraft insulation material used to create preformed insulation sections which are mounted to partially assembled transformer 2 to insulate the high voltage windings. FIG. 2 shows three arcuate outer edge end surface barrier layers 10, 12, 14 while FIG. 3 illustrates rectangular outer circumferential surface barrier layers 16, 18, 20. Barrier layers 10–20 are assembled and formed into the desired shapes using an outer section vacuum forming box 22 shown in FIG. 4. Box 22 has a circumferential wall 24, an end wall 26 and flange walls 28, 30, 32. Walls 24–32 all have vacuum openings 34 formed therein. Box 22 is coupled to a vacuum producing source, not shown, so that air is pulled into openings 34. The preformed sections are created by layering the cut creped kraft barrier layers 10–20 within box 22 as suggests in FIG. 5.

Figure 5:
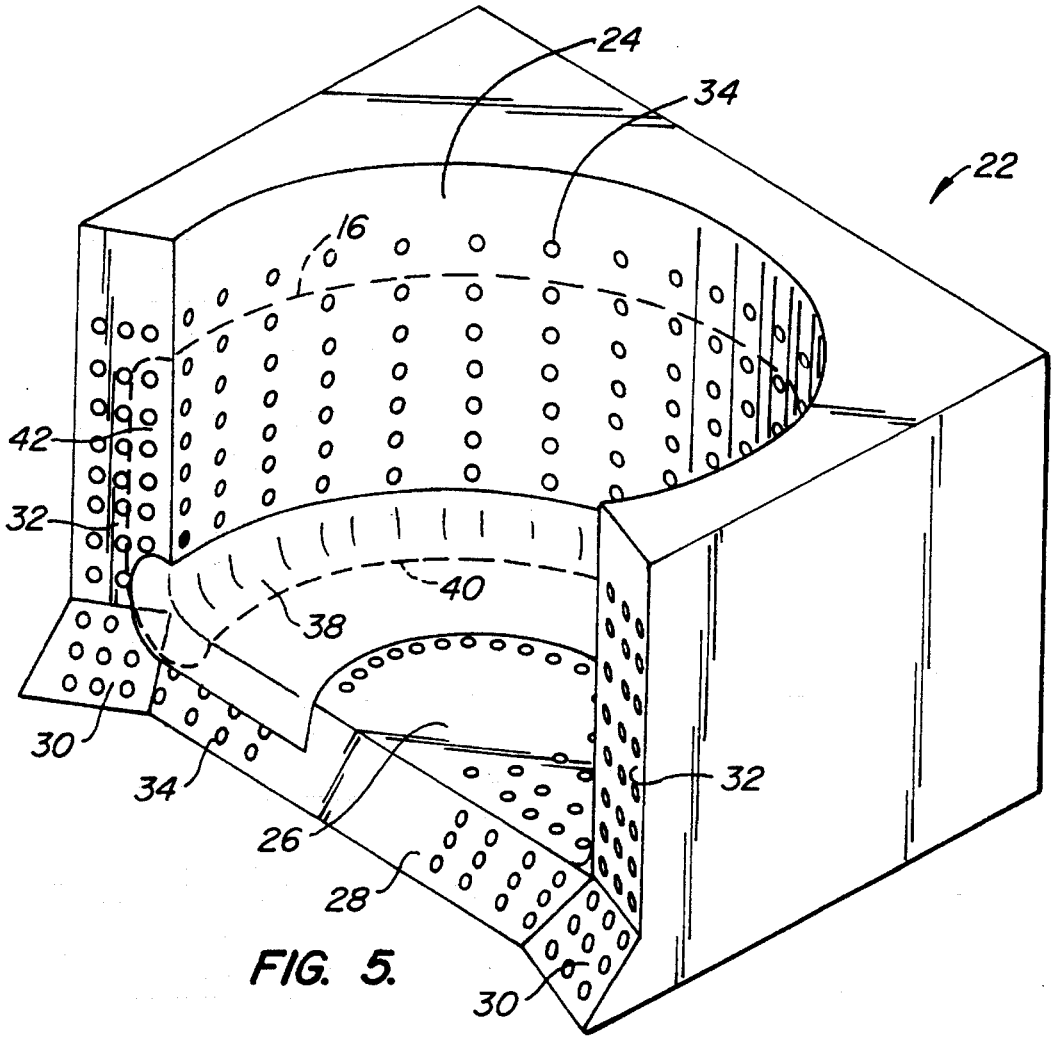
FIG. 5 is a view similar to that of FIG. 4 showing in solid lines an arcuate outer edge end surface barrier layer of FIG. 2 placed within the vacuum box of FIG. 4 and, in dashed lines, a rectangular outer circumferential surface barrier layer of FIG. 3 placed against the vacuum box illustrating how the barrier layers are overlapped at the corners in creating a preformed insulation section.
Figure 9:
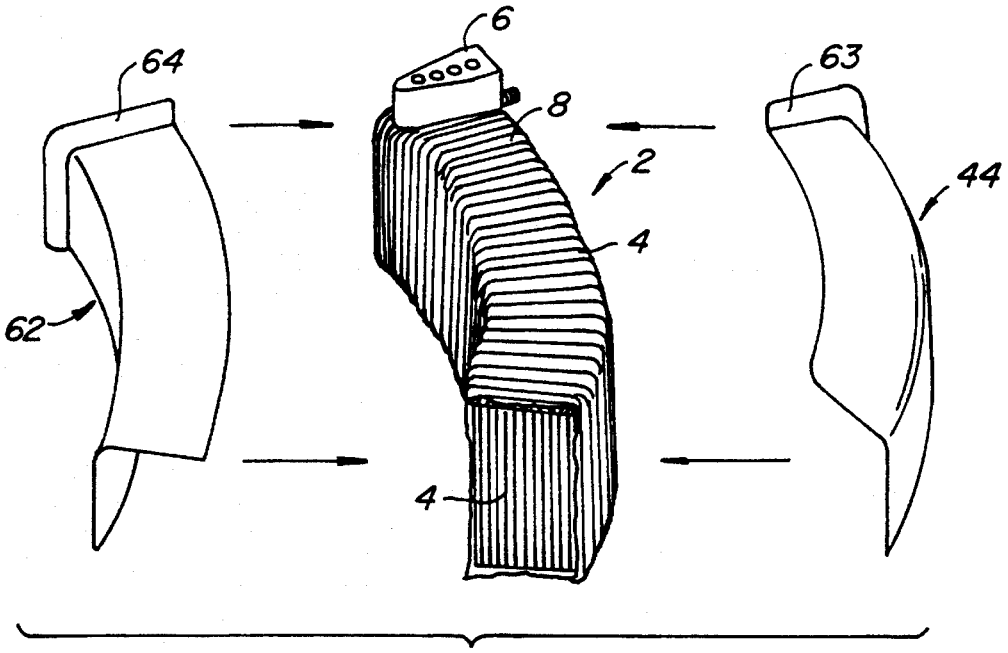
FIG. 9 is an enlarged view of a section of the partially assembled transformer of FIG. 1 shown together with inner and outer preformed insulation sections as they are about to be placed over the windings with the flanges adjacent the core support block.
Figure 6:
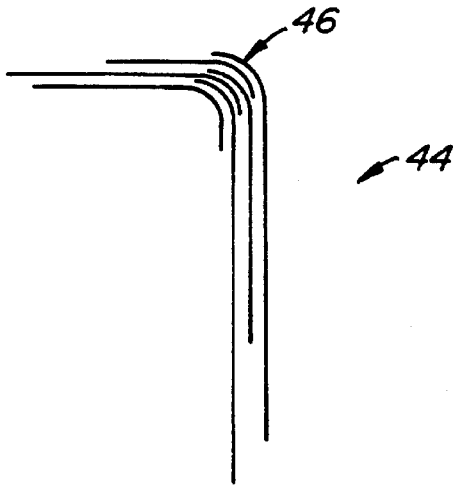
FIG. 6 is a simplified exploded edge cross sectional view of an outer preformed insulation section made using the barrier layers of FIGS. 2 and 3 adhered to one another using an adhesive and the vacuum forming box of FIG. 4 as suggested in FIG. 5.

FIG. 5 shows barrier layer 10 in solid lines mounted directly against end wall 26 with the outer edge 36 of barrier layer 10 folded up to lie adjacent circumferential wall 24. Also, end 37 of barrier layer 10 is folded down against flange walls 28, 30, 32. An adhesive, such as PVA, is then placed on a corner region 38 of formed barrier layer 10 created adjacent the intersection of end wall 26 and circumferential wall 24. The region of vacuum box 22 at the intersection of end wall 26 and circumferential wall 24 is heated to help set the temperature-sensitive adhesive. Rectangular outer circumferential surface barrier layer 16 is then mounted within vacuum box 22 as illustrated in dashed lines FIG. 5. As suggested in FIG. 5, most of barrier layer 16 lies against circumferential wall 24 with an outer edge 40 of barrier layer 16 overlying corner region 38 of barrier layer 10. The adhesive applied to corner region 38 acts to secure barrier layer 16 to barrier layer 10 at the corner formed therebetween. End 42 of barrier layer 16 is folded over and placed against flange walls 30, 32. This process is repeated for barrier layers 12, 18, 14 and 20 to create the outer preformed insulation section 44 as shown in FIGS. 6 and 9.

Figure 7:
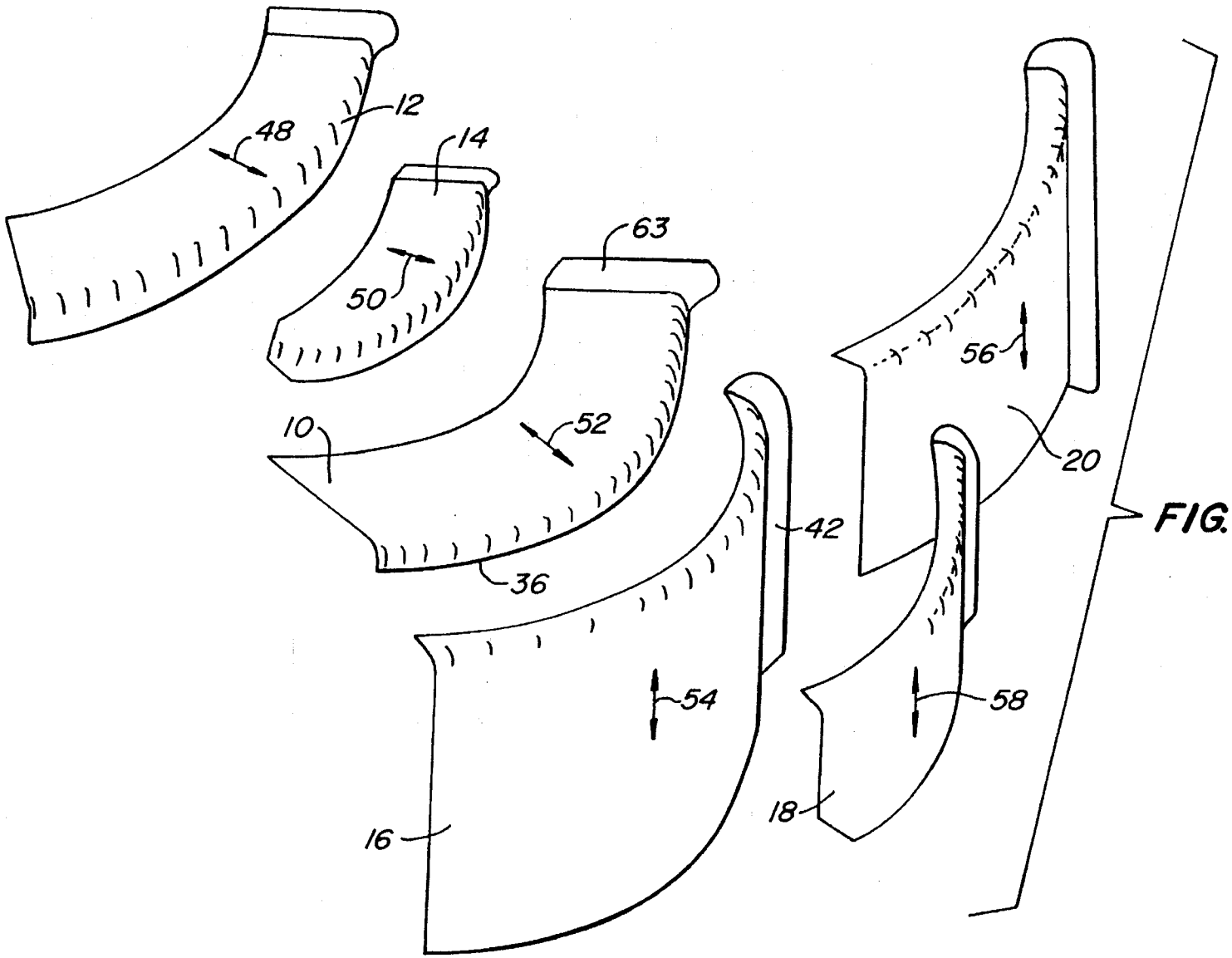
FIG. 7 is an exploded perspective view of what the individual barrier layers would look like after being formed into the outer preformed insulation section of FIG. 6.

Corner 46 of section 44 is six layers deep, in the example shown, to provide additional mechanical and electrical strength in the regions adjacent the corners of partially assembled transformer 2. The number of layers can be varied to suit requirements. FIG. 7 illustrates an exploded perspective view of what the barrier layers 10–20 would look like if disassembled after assembly using former box 22.

Barrier layers 10–20 are made of crepe kraft paper having grain directions illustrated by arrows 48, 50, 52, 54, 56 and 58. This permits the barrier layers to easily stretch in directions transverse to the grain directions. Therefore, insulating section 44, when placed on partially assembled transformer 2, can conform to the outer surface of the transformer to accommodate larger or smaller diameters as the various windings are wound about the transformer. Also, proper orientation of the grain directions help to prevent the material constituting preformed insulation section 44 from folding over or bunching up during winding operations due to its accordion-like nature. Ending the folding and bunching up of the insulation material helps keep the windings lying flat, thus increasing efficiency. It is preferred, however, that grain directions 48–58 of adjacent barrier layers not parallel but transverse to one another to a certain extent. This keeps the crepe kraft barrier material from nesting within one another, thus providing better mechanical and electrical insulation properties.

Figure 8:
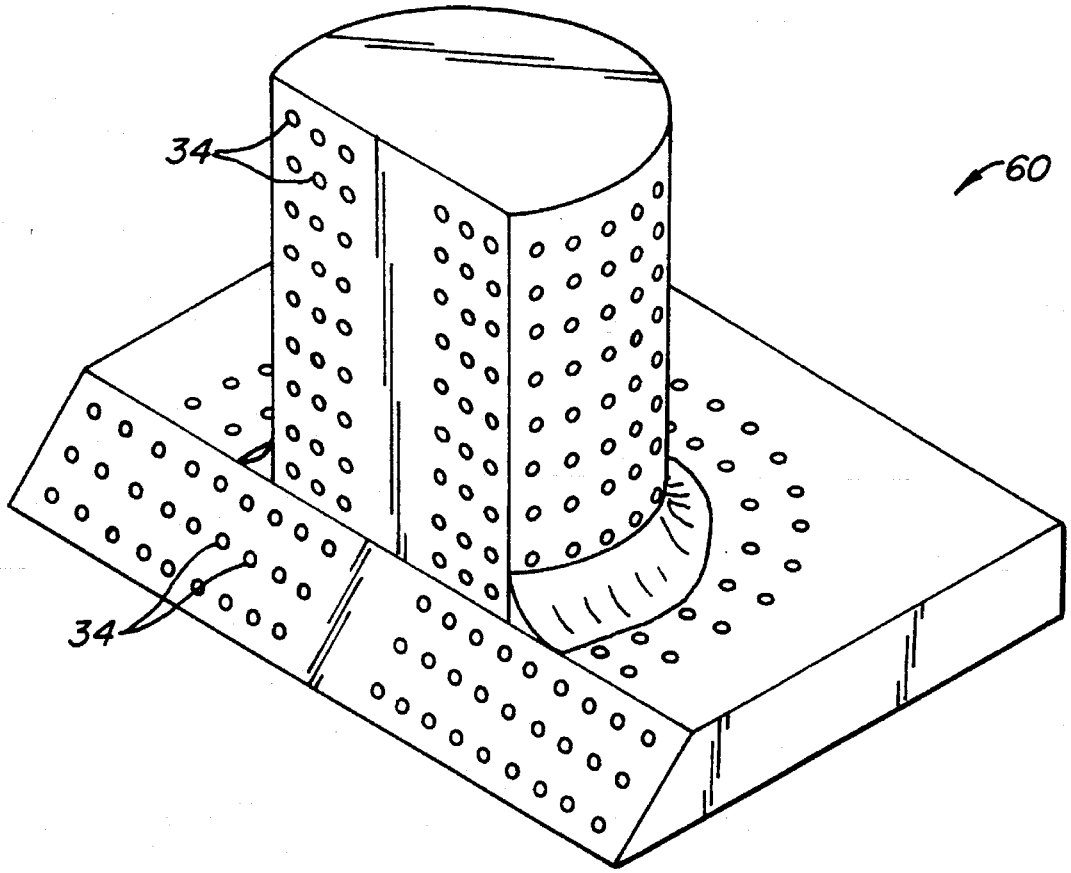
FIG. 8 is an isometric view of vacuum forming box used to create inner preformed insulation sections for placement within the eye of the partially assembled transformer of FIG. 1.

FIG. 8 illustrates a vacuum former box 60 for forming inner preformed insulation sections. These are sections, which are placed within the eye of partially assembled transformer 2, are made using cut creped kraft barrier layers similar to but somewhat smaller than layers 10–20. It should be noted that four outer preformed insulation sections 44 can be assembled using vacuum box 22 and four inner preformed insulation sections 62 can be made using vacuum former box 60. Two styles of each are made by forming the flanges of the insulation sections at two different ends and the other two are created by rotating the preforms 180° at assembly.

FIG. 9 illustrates the placement of an outer preformed insulation section 44 and an inner preformed insulation section 62 onto a section of partially assembled transformer 2. Flanges 63, 64 of insulation sections 44, 62 are positioned adjacent core support block 6 and against windings 8. Flanges 63, 64 provide dielectric isolation between layers of windings 8. Two outer preformed insulation sections 44 and two inner preformed insulation sections 62, mirror images of one another, are used at the end of winding 8.

During winding of high voltage windings 8, wire is placed in layers in a zig-zag or back and forth pattern. Each layer of high voltage windings 8 is connected to the previous layer at one end and progressively insulated towards the opposite end. That is, insulation is thickest where the differential voltage between adjacent layers of windings 8 is the greatest. This aspect is discussed below with reference to FIG. 13.

Figure 10:
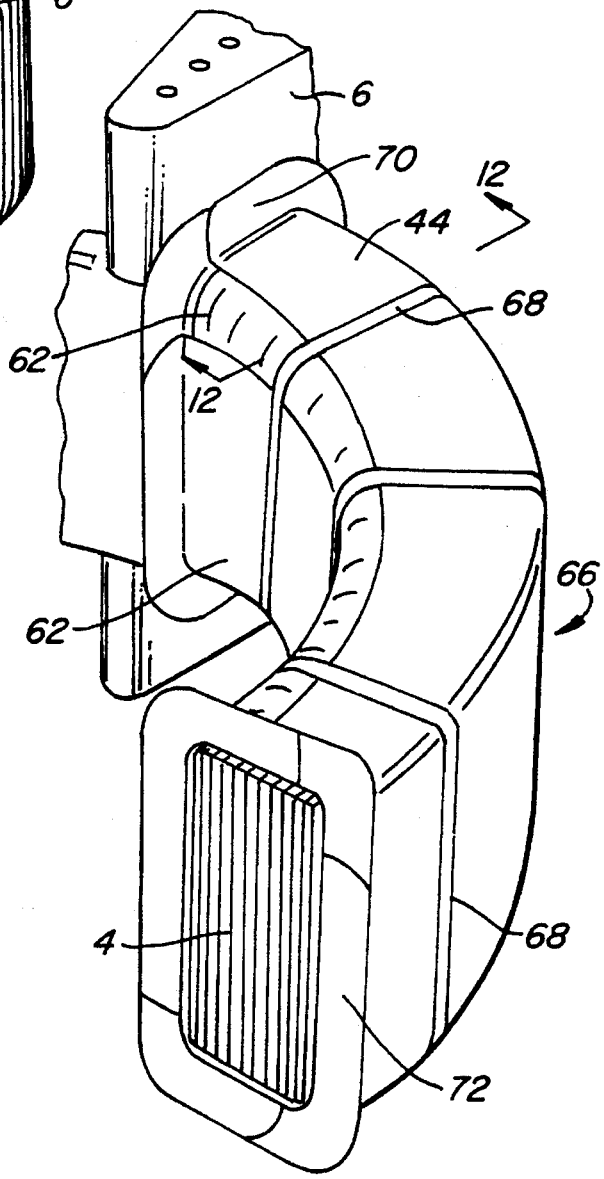
FIG. 10 shows the result of securing four inner and four outer preformed insulation sections to one section of a partially assembled transformer.

FIG. 10 illustrates a tubular insulation layer 66 made up of four outer insulation sections 44 and four inner insulation sections 62 after having been secured to partially assembled transformer 2 using tape 68 to hold the sections in place. This type of insulation is preferably used between high and low voltage windings, as discussed below with reference to FIG. 13. Other methods for holding the insulation sections in place prior to winding another layer of wire onto the partially assembled transformer could be used as well. Tubular insulation layers 66 is seen to include flanges 70, 72 at each end lying adjacent support blocks 6.

Figure 12:
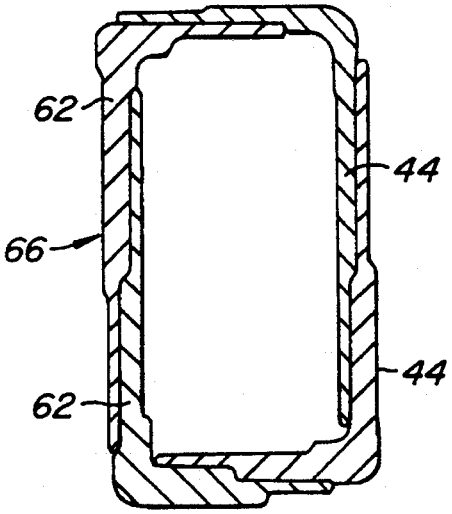
FIG. 12 is a cross-sectional view of the tubular insulation layer taken along line 12—12 of FIG. 10 with the thicknesses exaggerated to show the variance of the thickness of the preformed insulation sections.
Figure 11:
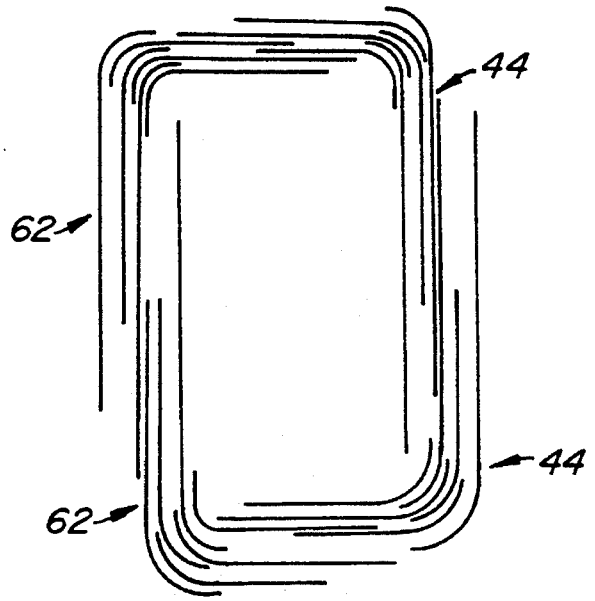
FIG. 11 is a simplified cross-sectional illustration similar to that of FIG. 6 but showing the overlapping nature of two outer and two inner preformed insulation sections placed around the windings of a partially assembled transformer.

Referring to FIGS. 11 and 12, the overlapping nature of sections 44, 62 is illustrated schematically in FIG. 11. The extra material at corners 46 is quite evident. FIG. 12 is a simplified cross-sectional view of tubular insulation layer 66 with the thickness of the layer exaggerated. As this figure suggests, sections 44, 62 could be made in ways other than using several layers of material. For example, sections 44, 62 could be molded or pressed materials. However, using crepe kraft material as the barrier layers allows the same size barrier layers to be used even though the surface of the partially assembled transformer 2 changes as each layer of windings 8 is wound on the transformer. Of course extreme size differences may require a use of a different set of barrier layers sized to accommodate the surface to be covered.

In the preferred embodiment some of barrier layers 10–20 are long enough so that their ends reach from one support block 6 to the other; however they need not be this long in all cases. As shown in FIG. 9, sections 44, 62 have flanges 63, 64 at one end but not the other. However, when placing insulation sections 44, 62 onto partially assembled transformer 2, the unformed end, if it reaches the other support block 6, is folded upwardly to create a flange at that end at well.

Figure 13:
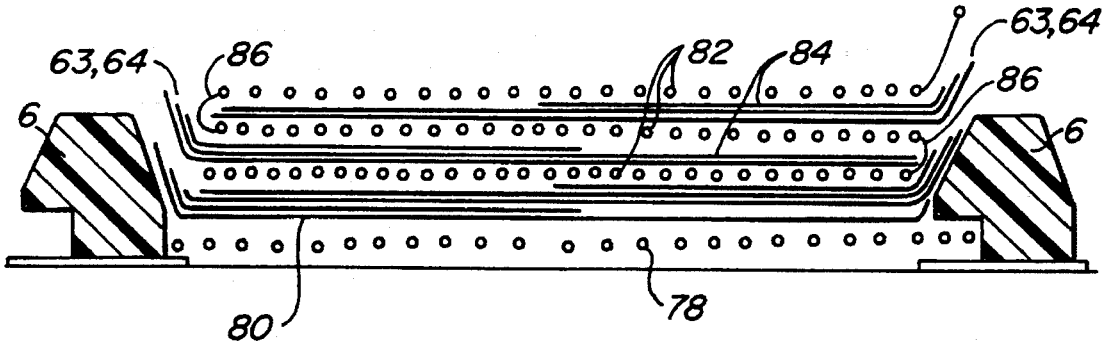
FIG. 13 is a simplified, stretched-out, cross-sectional representation of a 180° arc section of a transformer made according to the present invention.

FIG. 13 is a somewhat symbolic cross-section representation of a 180° arc section 76 of a transformer made according to the present invention. Section 76 includes one (or more) low voltage windings 78 wound between core support blocks 6. Paired preforms 80 (including four sections 44 and four sections 62), as shown in FIG. 10, are used to cover windings 78. Three layers of high voltage windings 82 are shown wound on top of low voltage winding 78. As can be seen, each layer of high voltage windings 82 is separated a single preform 84 of two sections 44 and two sections 62 with their flanges 63, 64 positioned at alternating ends of high voltage windings 82. The end of one high voltage winding 82 is connected to the start of the next winding 82 by connection wires 86. The alternating placement of preforms 84 provides the greatest dielectric insulation between the ends of adjacent high voltage windings 82 that are not connected by wires 86 and thus have the highest voltage differential.

The amount of overlap between sections 44, 62 changes as the size of the transformer changes. In this way, the system is universal. The invention preferably uses single crepe material which permits the material to expand up to 100% in the creped direction. Double crepe material permits the material to stretch in two directions, typically about 35% in either direction. This could be useful in certain situations. Uncreped kraft could be used for cut parts which do not need to stretch in application.

The insulation layer 66, in this preferred embodiment, forms an arc of about 165°. Other arc lengths are possible as well. In some situations the diameter of circumferential wall 24 of vacuum form box 22 may need to be changed as the diameter of partially assembled transformer 2 changes. Similar modifications could be necessary for vacuum form box 60. Preferably corners 46 are about 50% to 200% thicker than the average thickness of the wall sections of tubular insulation layer 66.

In use, barrier layers 10–20 are formed into outer preformed insulation sections 44 using vacuum form box 22. Another set of appropriately sized barrier layers, similar to barrier layers 10–20, are used with vacuum formed box 60 to create inner preformed insulation sections 62. After all six barrier layers 10–20 are in place, a limp plastic sheet is placed over surfaces 24–32 of vacuum form box 22 and layers 10–20. The suction created through vacuum openings 34 pulls layers 10–20, since they are air-permeable, tightly against one another for a good bond and to set layers 10–20 into the proper shape. Insulation sections 44, 62 are then mounted to partially assembled transformer 2 so to cover windings 8 between core support blocks 6. Sections 44, 62 are held in place by tape 68 or other appropriate methods, such as with an adhesive. The next winding 8 is then wound upon tubular insulation layer 66 so the process can be repeated.

Modification and variation can be made to disclose the embodiment without departing from the subject of the invention as defined in the following claims.

What is claimed is:

1. A transformer insulation assembly, for insulating one layer of windings from an adjacent layer of winding, comprising a tubular member defining a central axis and having an outer wall that defines a central opening extending the length of said member, said outer wall being formed by preformed sections of electrical insulating material, said preformed sections having overlapping surfaces that are slidably positioned relative to one another such that the extent of said surfaces that overlap can be changed to vary the size of said opening, each preformed section comprising a plurality of sheets of stretchable material, each preformed section including at least two side walls and a corner that forms a junction therebetween said corner extending generally parallel to the center axis of said tubular member and having a substantially uniform thickness along its length, the thickness of said corner being substantially greater than the average thickness of said side walls.

2. The assembly of claim 1 wherein each sheet of a respective section forms a portion of the corner of that section.

3. The assembly of claim 2 wherein the sheets of a respective section forms a portion of the corner of that section.

4. The assembly of claim 2 wherein each sheet of a respective section forms a portion of one of the side walls of that section.

5. The assembly of claim 2 wherein the sheets have maximum stretch in at least one direction, and the stretchable sheets of a respective section are layered one upon another and oriented such that adjacent sheets have their directions of maximum stretch in different directions.

6. The assembly of claim 2 wherein said sheets include a plurality of generally parallel ribs, the sheets of a respective section being layered one upon another and oriented such that the ribs on adjacent sheets are substantially nonparallel.

7. The assembly of claim 2 wherein each sheet of a respective section includes a flange portion, said flange portions forming a flange that extends radially from said outer wall.

8. The assembly of claim 1 wherein said tubular member is arc shaped.

9. A transformer insulation assembly, for insulating one layer of winding from an adjacent layer of winding, comprising a tubular member, having an outer wall that defines a central opening extending the length of said member, said outer wall being formed by performed sections of electrical insulating material, said performed sections having overlapping surfaces that are slidable positioned relative to one another such that the extent of said surfaces that overlap can be changed to vary the size of said opening, each preformed section comprising a plurality of sheets of stretchable material, said sheet including a plurality of generally parallel ribs, the sheets of a respective sections being layered one upon another and oriented such that ribs on adjacent sheets are substantially nonparallel.

10. A transformer insulation assembly, for insulating one layer of winding from an adjacent layer of winding, comprising a tubular member, having an outer wall that defines a central opening extending the length of said member, said outer wall being formed by performed sections of electrical insulating material, said preformed sections having overlapping surfaces that are slidably positioned relative to one another such that the extent of said surfaces that overlap can be changed to vary the size of said opening, said tubular member including at least four preformed sections each having a pair of side walls and a corner that forms a juncture therebetween, each side wall of a side wall pair overlapping a side wall of another side wall pair to form a tubular segment of said tubular member.

11. The assembly of claim 10 wherein the average thickness of said corners are at least 150% of the average thickness of said side walls.

12. The assembly of claim 10 wherein said four preformed sections each comprise a plurality of sheets of stretchable material.

13. The assembly of claim 12 wherein each sheet of a respective section forms a portion of the corner of that section.

14. The assembly of claim 12 wherein the elastic sheets of a respective section are layered one upon another and oriented such that adjacent sheets are stretchable in different directions.

15. The assembly of claim 12 wherein said sheets include a plurality of generally parallel ribs, the sheets of a respective section being layered one upon another and oriented such that ribs on adjacent sheets are substantially nonparallel.

16. The assembly of claim 12 wherein each sheet includes a flange portion, said flange portions forming a flange that extends radially from said tubular member.

17. A transformer insulation assembly, for insulating one layer of windings from an adjacent layer of winding, comprising an arc-shaped tubular member, having an outer wall that defines a central opening extending the length of said member, said outer wall being formed by preformed sections of electrical insulating material, said preformed sections having overlapping surfaces that are slidably positioned relative to one another such that the extent of said surfaces that overlap can be changed to vary the size of said opening.

18. The assembly of claim 17 wherein each preformed section comprises a plurality of sheets of stretchable material.

19. The assembly of claim 18 wherein said tubular member has a center axis, and wherein each preformed section includes at least two side walls and a corner that forms a junction therebetween, said corner extending generally parallel to the center axis of said tubular member and having a substantially uniform thickness along its length, the thickness of said corner being substantially greater than the average thickness of said side walls.

20. The assembly of claim 18 wherein the sheets are each stretchable in at least one direction, and the stretchable sheets of a respective section are layered one upon another and oriented such that adjacent sheets are stretchable in different directions.

21. The assembly of claim 18 wherein said sheets include a plurality of generally parallel ribs, the sheets of a respective section being layered one upon another and oriented such that ribs on adjacent sheets are substantially nonparallel.

22. The assembly of claim 17 wherein said tubular member includes at least four preformed sections each having a pair of side walls and a corner that forms a juncture therebetween, each side wall of a side wall pair overlapping a side of wall of another side wall pair to form a tubular segment of said tubular member.

23. The assembly of claim 17 wherein said tubular member forms an arc less than about 180 degrees.

24. The assembly of claim 17 wherein said preformed sections comprise crepe material.

25. A transformer insulation assembly, for insulating one layer of windings from an adjacent layer of winding, comprising a tubular member, having an outer wall that defines a central opening extending the length of said member, said outer wall being formed by preformed sections of electrical insulating material, said preformed sections having overlapping surfaces that are slidably positioned relative to one another such that the extent of said surfaces that overlap can be changed to vary the size of said opening, said preformed sections comprising crepe material.

* * * * *